US006641509B1

(12) United States Patent
Chen

(10) Patent No.: US 6,641,509 B1
(45) Date of Patent: Nov. 4, 2003

(54) MULTIFUNCTIONAL EXERCISE DEVICE

(76) Inventor: James Chen, No. 35, Tun Hi Rd., Chin Chan Li, Sa Lu Chen, Taichung Hsien (TW)

( * ) Notice: Subject to any disclaimer, the term of this patent is extended or adjusted under 35 U.S.C. 154(b) by 267 days.

(21) Appl. No.: 09/706,821

(22) Filed: Nov. 7, 2000

(30) Foreign Application Priority Data

Oct. 4, 2000 (TW) ..... 89217192 U

(51) Int. Cl.[7] ..... A63B 21/06
(52) U.S. Cl. ..... 482/94; 482/97; 482/138
(58) Field of Search ..... 482/95–96, 97, 482/100, 92–94, 98, 99, 135–138

(56) References Cited

U.S. PATENT DOCUMENTS 4,815,732 A * 3/1989 Mahvi ..... 482/142
5,330,405 A * 7/1994 Habing et al. ..... 482/96
5,334,120 A * 8/1994 Rasmussen ..... 482/97
5,409,440 A * 4/1995 Yang ..... 482/138
6,030,324 A * 2/2000 McBride ..... 482/142

* cited by examiner

*Primary Examiner*—Stephen R. Crow
(74) *Attorney, Agent, or Firm*—Browdy and Neimark, P.L.L.C.

(57) ABSTRACT

A multifunctional exercise device comprises a base, an arm-building mechanism, a leg-building mechanism, a weight unit, and a transmission mechanism. The base is formed of a seat and a plurality of rod members. The arm-building mechanism is mounted on the top of the base and is formed of two fitting members, with each being provided with two support rods for supporting a pull rod which is selectively held in the retaining holes of the support rods. The fitting members are pivotally fastened with a connection rod which is in turn pivoted with a bias rod. The leg-building mechanism is connected with the arm-building mechanism. The weight unit is disposed on the arm-building mechanism and is composed of a resistance rod and a plurality of weights which are fitted over the resistance rod for providing the exercise device with a damping effect. The transmission mechanism comprises a plurality of fixed pulleys and a pull cord which is fastened at one end with the arm-building mechanism such that other end of the pull cord runs through the fixed pulleys mounted on the base in various directions and angles.

6 Claims, 5 Drawing Sheets

MULTIFUNCTIONAL EXERCISE DEVICE

FIELD OF THE INVENTION

The present invention relates generally to an exercise device, and more particularly to a multifunctional exercise device.

BACKGROUND OF THE INVENTION

The exercise devices disclosed in the U.S. Pat. Nos. 4,836,535; 4,9861,538; 4,898,381; and 5,1018,725 are designed for doing only one type of exercise. In light of such exercise devices with a single purpose, one must purchase a variety of exercise devices to engage in exercise activities of various types. These exercise devices take up a lot of floor spaces.

The U.S. Pat. No. 5,217, 422 discloses a multifunctional exercise device comprising a leg building mechanism and an arm building mechanism which is disposed between the leg building mechanism and a plurality of weights capable of being moved by the leg building mechanism. The arm building mechanism has a plurality of connection rods which are interconnected in various manners so as to move the weights to locate at a predetermined position in conjunction with the leg building mechanism. The connection rods are rotatably interconnected such that the revolving radius of each connection rod is apt to be excessively large in the course of operation, thereby causing the exercise device in operation to be rather unstable. In addition, the connection rods are asymmetrically pivoted. As a result, the pivoting points of the connection rods are vulnerable to damage at the time when the connection rods are at work. In light of the leg building mechanism being exerted on by a leg force which is greater than an arm force exerting on the arm building mechanism the exercise effects of the leg building mechanism and the arm building mechanism can not be equally realized at the same time.

SUMMARY OF THE INVENTION

It is the primary objective of the present invention to provide an exercise device which is stable while in operation.

It is another objective of the present invention to provide an exercise device capable of concentrating the forces exerting thereon, so as to prevent the exercise device from being damaged by the forces.

It is still another objective of the present invention to provide an exercise device, with means enabling an exerciser to build the legs and the hands of the exerciser effectively and simultaneously.

It keeping with the principle of the present invention, the foregoing objectives of the present invention are attained by the exercise device comprising a base, an arm-building mechanism, a leg-building mechanism, a weight unit, and a transmission mechanism.

The base is formed of a seat and a plurality of rods. The arm-building mechanism is mounted on the top of the base and is formed of two fitting members, with each being provided with two support rods for supporting a pull rod which is selectively held in the retaining holes of the support rods. The fitting members are fastened pivotally with a connection rod which is in turn pivoted with a bias rod. The leg-building mechanism is connected with the arm-building mechanism. The weight unit is disposed on the arm-building mechanism and is composed of a resistance rod and a plurality of weights which are fitted over the resistance rod for providing the exercise device with a damping effect.

The transmission mechanism comprises a plurality of fixed pulleys and a pull cord which is fastened at one end with the arm-building mechanism such that other end of the pull cord runs through the fixed pulleys mounted on the base in various directions and angles.

DETAILED DESCRIPTION OF THE INVENTION

Figure 1:
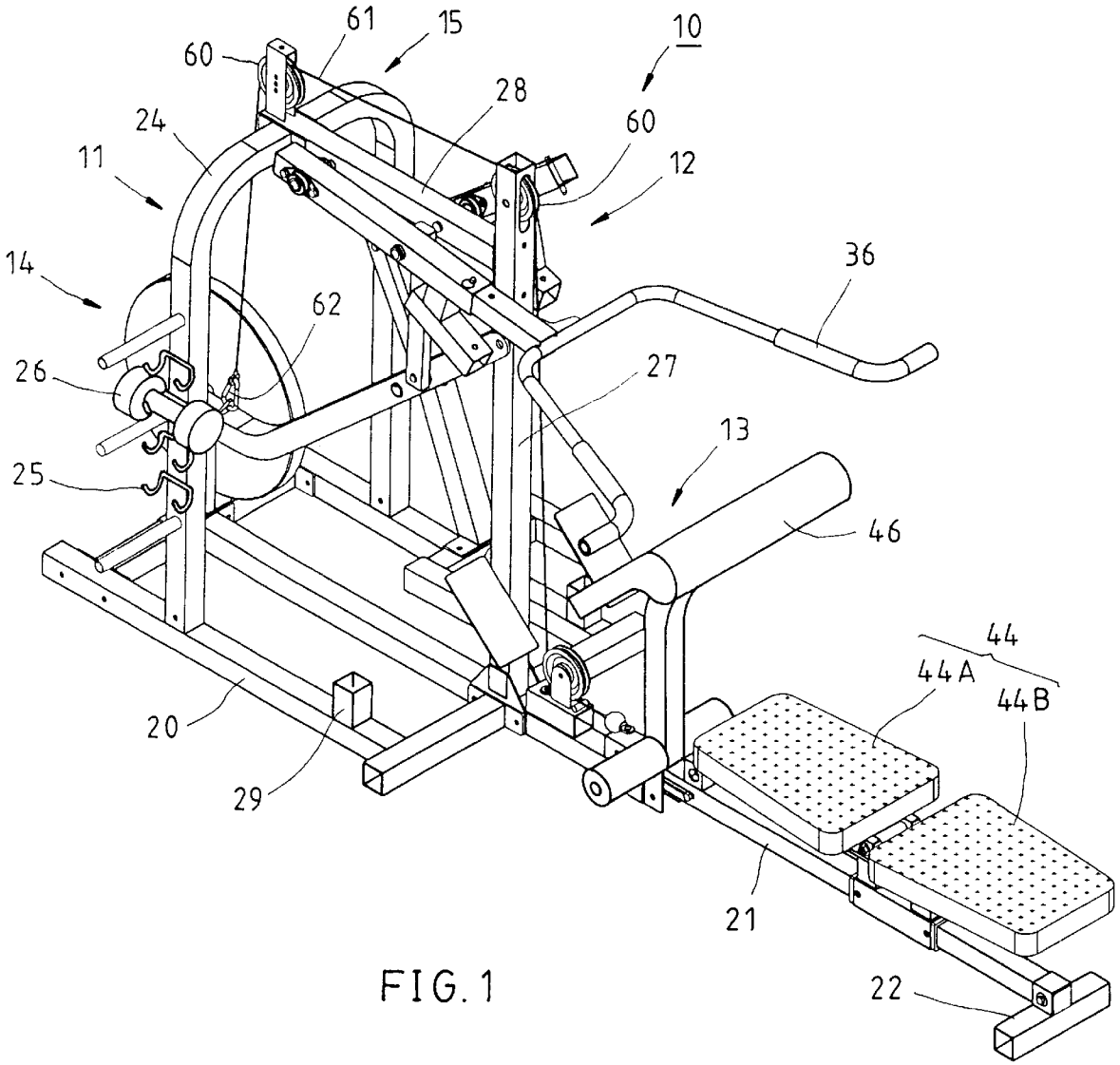
FIG. 1 shows a perspective view of a first preferred embodiment of the present invention.
Figure 2:
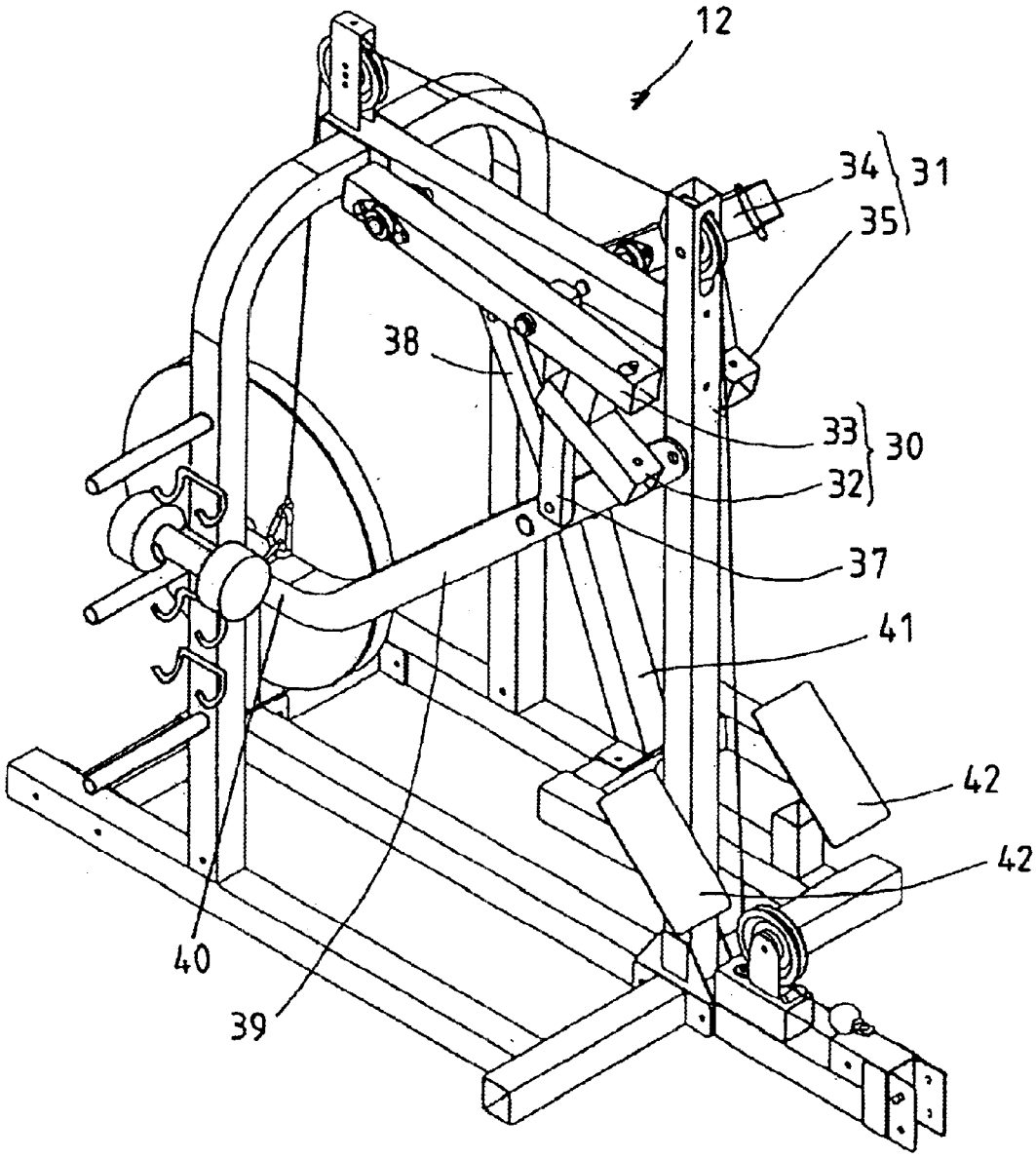
FIG. 2 shows a schematic view of the first preferred embodiment of the present invention at work.
Figure 3:
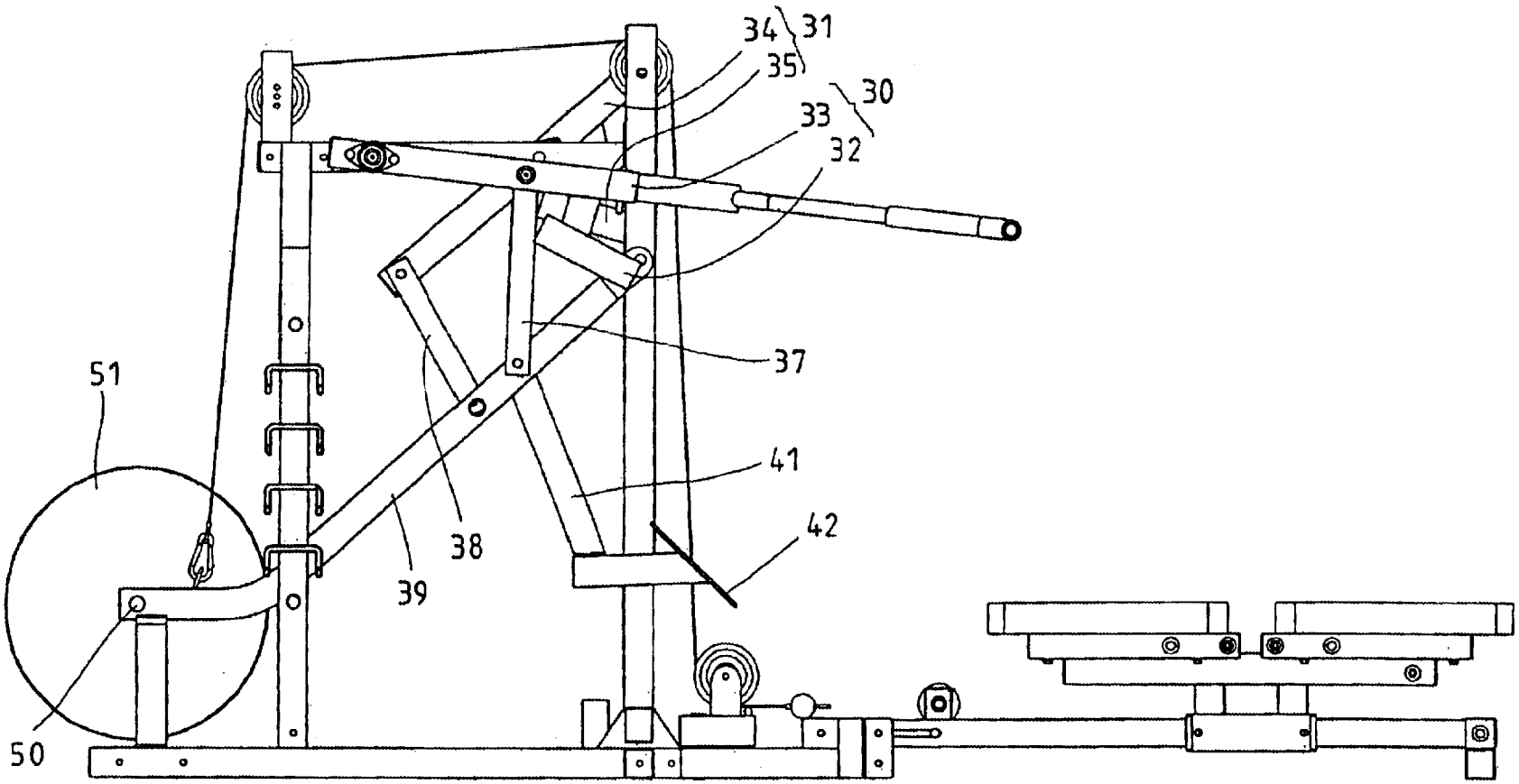
FIG. 3 shows a side schematic view of the first preferred embodiment of the present invention at work.
Figure 4:
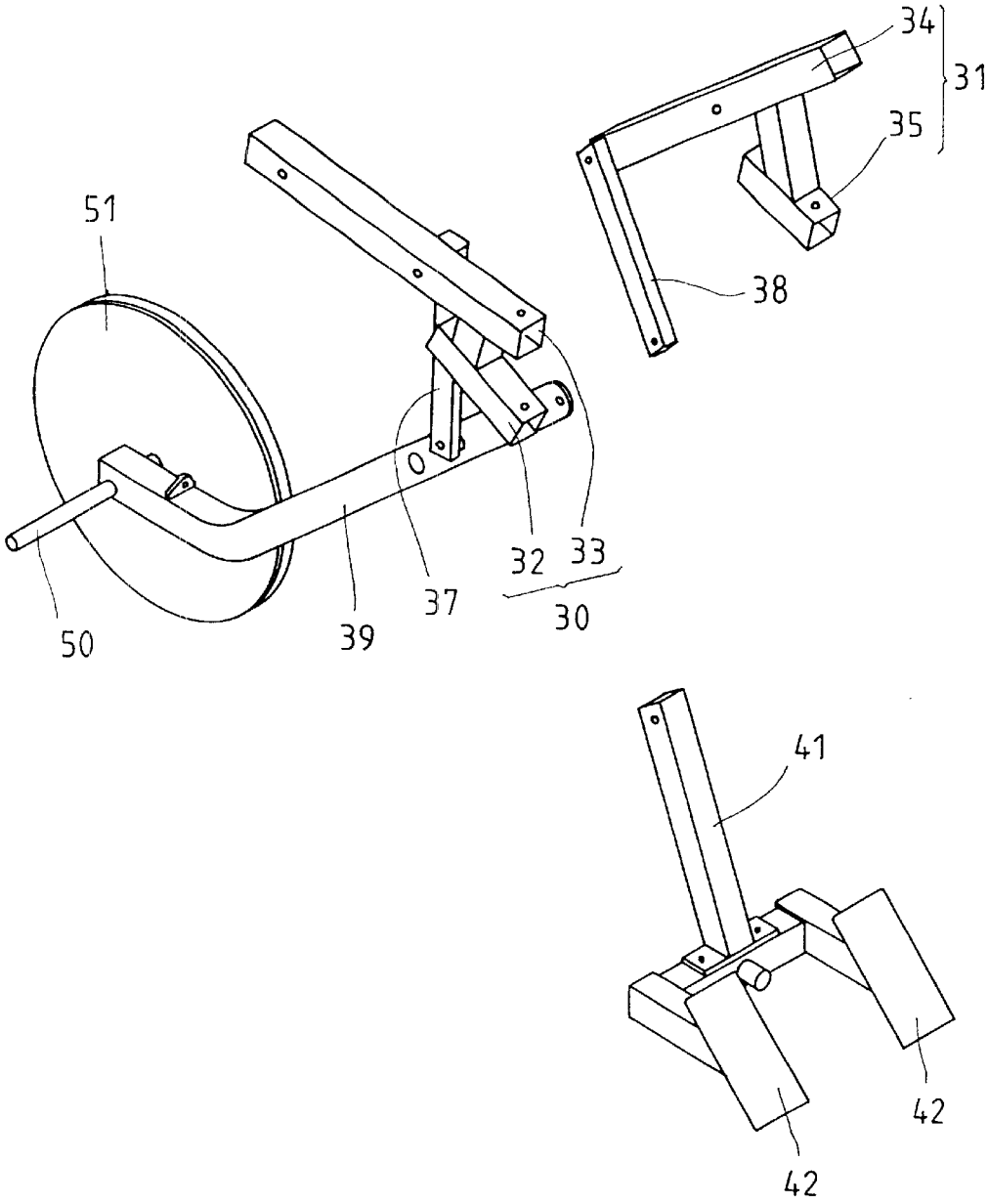
FIG. 4 shows an exploded view of the arm-building mechanism and the leg-building mechanism of the first preferred embodiment of the present invention.

As shown in FIGS. 1–4, a multifunctional exercise device 10 embodied in the present invention comprises a base 11, an arm-building mechanism 12, a leg-building mechanism 13, a weight unit 14, and a transmission mechanism 15.

The base 11 has a seat 20 of a rectangular construction, a long rod 21 of a predetermined length and extending forward from the front end of the seat 20, a support seat 22 connected with the top end of the long rod 21, a U-shaped rod 24 fastened with the seat 20 and provided with a plurality of carrying members 25 for carrying a dumbbell 26 to be used in building the biceps of the upper arms of an exerciser, a straight rod 27 disposed at the junction of the long rod 21 and the seat 20, a cross rod 28 fastened at one end with the U-shaped rod 24 and at other end with the straight rod 27 for reinforcing the U-shaped rod 24 and the straight rod 27, and a retaining tube 29 mounted on the seat 20.

Figure 5:
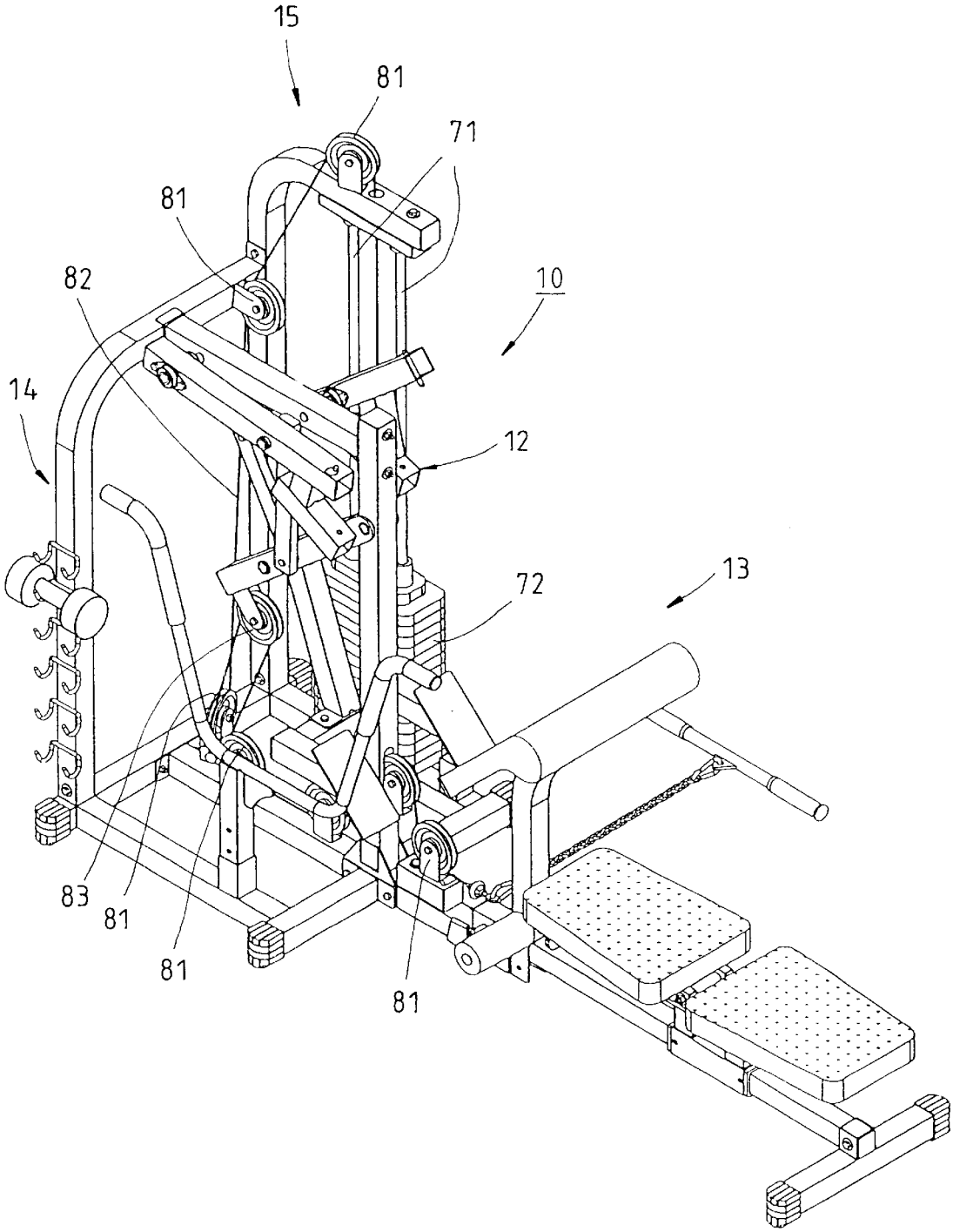
FIG. 5 shows a perspective view of a second preferred embodiment of the present invention.

The arm-building mechanism 12 comprises a first fitting member 30 and a second fitting member 31. The first fitting member 30 is formed of a first support rod 32 and a second support rod 33. The second fitting member 31 is formed of a third support rod 34 and a fourth support rod 35. The first and the second fitting members 30 and 31 are fastened pivotally with the cross rod 28 such that the support rods 32, 33, 34 and 35 are variously oriented to facilitate the retaining of the pull rod 36 in the retaining holes of the support rods. When the exercise device is not in use, the pull rod 36 is retained by the retaining tube 29 as shown in FIG. 5. The second support rod 33 is pivoted with a first connection rod 37 which is pivoted at other end with a bias rod 39 which is in turn pivoted at other end with the straight rod 27. The bias rod 39 has a slanted end 40 which is rested against the seat 20. The fourth support rod 35 is pivoted with a second connection rod 38 which is in turn pivoted at other end with the bias rod 39.

The leg-building mechanism 13 comprises a U-shaped leg frame 41 connected with the bias rod 39, two pedals 42 fastened with the leg frame 41, two seats 44 mounted on the long rod 21 and provided with a seat pad 44A and a rest pad 44B which can be erected, and a support pad 46 disposed on the long rod 21 such that the support pad 46 is located between the pedals 42 and the seats 44. The support pad 46 is used as an armrest.

The weight unit 14 comprises a resistance rod 50 and a plurality of weights 51. The resistance rod is put through the tail end of the bias rod 39. The weights 51 are held on the resistance rod 50 for providing the exercise device with a damping effect.

The transmission mechanism 15 comprises a plurality of fixed pulleys 60, a pull cord 61, and a hook 62. The fixed pulleys 60 are mounted on the U-shaped rod 24, the straight rod 27 and the long rod 21 in various directions and at various angles. The pull cord 61 is retained at one end by the bias rod 39 by means of the hook 62 such that other end of the pull cord 61 runs through the pulleys 60. The reaction force of the weight unit 14 is transmitted by the pull cord 61. The free end of the pull cord 61 may be fastened with other type of exercise mechanism. When the pull cord 61 is not in use, the hook 62 is taken away from the bias rod 49 to facilitate the storage of the pull cord 61.

When the exercise device of the present invention is in the first operational state, the pull rod 36 is first retained on the first support rod 32 before the pull rod 36 is held by both hands of an exerciser. The pull rod 36 is held by both hands of an exerciser. The pull rod 36 is then raised to actuate the first connection rod 37 to move upward, thereby causing the bias rod 39 to move upward. In light of the tail end of the bias rod 39 being connected with a plurality of weights 51, the muscle-building effect is brought about on trapezium, deltoid, and latissimus dorsi.

When the exercise device of the present invention is in the second operational state, the pull rod 36 is first retained on the second support rod 33 and is then held by both hands of an exerciser. As the pull rod 36 is raised, the first connection rod 37 is actuated to move upward, thereby causing the bias rod 39 to move upward. In light of the tail end of the bias rod 39 being connected with a plurality of weights 51, the muscle-building effect is thus brought about on trapezium, deltoid, and triceps.

When the exercise device of the present invention is in the third operational state, the pull rod 36 is first retained on the third support rod 34 and is then held by other hands of an exerciser. As the pull rod 36 is pulled down, the second connection rod 38 is actuated to move upward, thereby causing the bias rod 39 to move upward. As a result, the muscle-building effect is brought about on trapezium, biceps, and pectoralis major.

When the exercise device of the present invention is in the fourth operational state, the pull rod is first retained on the fourth. support rod 35 and is then held by both hands of an exerciser. As the pull rod 36 is pulled downward, the second connection rod 38 is actuated to move upward, thereby causing the bias rod 39 to move upward. The muscle-building effect is thus brought about on latissimus dorsi, biceps, and trapezium.

In light of the bias rod 39 being connected with the U-shaped leg frame 41, the exercising modes described above may be carried out in conjunction with the pedals 42 for building the muscles of arms, chest, and legs of an exerciser.

The first and the second fitting members 30 and 31 are symmetrically mounted on the cross rod 28 and are linked the U-shaped leg frame 41 by the bias rod 39. The excise device of the present invention is therefore stable by virtue of the effect of such a leverage and the effect of centration of force exerting on the exercise device. Under the circumstance that the U-shaped leg frame 41 carries a predetermined load and that the U-shaped leg frame 41 is exerted on by a force, the moment of force brought about in relation to its pivoting point is greater than the moment of force brought about by the support rods 32, 33, 34, and 35 in relation to their pivoting point. As a result, when the arms and the legs of the exerciser are engaged in the exercise at the same time, the force exerting on the legs is greater than the force exerting on the arms.

As shown in FIG. 5, the second preferred embodiment of the present invention is different from the first preferred embodiment described above in design in that the former comprises the weight unit 16 which is composed of two shock-absorbing rods 71 and a plurality of weights 72 disposed between the two shock-absorbing rods 71. In addition, the load transmission of the second preferred embodiment is attained by the fixed pulleys 81 and the pull cord 82 of the transmission mechanism 17. Furthermore, the bias rod 39 of the second preferred embodiment is provided with a movable pulley 83 through which the pull cord 82 runs. As a result, when the movable pulley 83 is forced to move up and down, the reaction force of the weights 72 is resisted by the movable pulley 83 at such time when the arm-building mechanism 18 or the leg-building mechanism 19 is in operation.

What is claimed is:

1. A multifunctional exercise device comprising:

a base formed of a seat and a plurality of rod members;

an arm-building mechanism mounted on said base having a pull rod engaged thereon so as to bring about a pivoting action relative to the base;

a leg-building mechanism and said arm-building mechanism, both being engaged to a bias rod, such that said two mechanisms work together; and a weight unit disposed on said arm-building mechanism and formed of a plurality of weights to bring about a damping effect;

wherein said arm-building mechanism comprises two fitting members which are symmetrically disposed on a top of said base and are each formed of two support rods located at different levels for retaining said pull rod, each of said two fitting members being pivotally engaged to a connection rod which is in turn pivoted to the bias rod;

wherein moment of force brought about by said leg-building mechanism in relation to a pivoting point thereof is greater than moment of force brought about by said support rods of said arm-building mechanism in relation to pivoting points of said support rod; and wherein said weight unit comprises a resistance rod and a plurality of weight, with said resistance rod being disposed on said bias rod, and with said weights being fitted over said resistance rod.

2. The exercise device as defined in claim 1, wherein said leg-building mechanism comprises a U-shaped leg frame which is connected with said bias rod.

3. The exercise device as defined in claim 1 further comprising a transmission mechanism having a plurality of pulleys and a pull cord running through said pulleys.

4. The exercise device as defined in claim 1, wherein a support pad for use as an armrest is provided on the exercise device.

5. The exercise device as defined in claim 1, wherein said base is provided with a retaining tube for retaining said pull rod.

6. The exercise device as defined in claim 1, wherein said base is provided with a plurality of carrying members for carrying dumbbells.

* * * * *